US008109682B2

(12) United States Patent
Eoka et al.

(10) Patent No.: US 8,109,682 B2
(45) Date of Patent: Feb. 7, 2012

(54) PRINTER FOR A PLURALITY OF LAYERED SHEETS

(75) Inventors: Kenji Eoka, Sunto-gun (JP); Kazuyoshi Kurihara, Singapore (SG); Shigetoshi Asahina, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 755 days.

(21) Appl. No.: 11/952,528

(22) Filed: Dec. 7, 2007

(65) Prior Publication Data

US 2009/0148218 A1 Jun. 11, 2009

(51) Int. Cl.
*B41J 11/26* (2006.01)

(52) U.S. Cl. ..... 400/605; 400/55; 400/124.01; 400/632

(58) Field of Classification Search ..... 400/605
See application file for complete search history.

(56) References Cited

U.S. PATENT DOCUMENTS

| | | | | | |
|---|---|---|---|---|---|
| 1,524,742 | A | * | 2/1925 | Lynch | 400/519.3 |
| 2,080,524 | A | * | 5/1937 | Allen | 400/616.2 |
| 3,900,098 | A | * | 8/1975 | Effinger | 400/552 |
| 4,767,114 | A | * | 8/1988 | Nishimoto | 400/625 |
| 4,989,771 | A | * | 2/1991 | Ferguson | 226/74 |
| 5,061,096 | A | * | 10/1991 | Hauslaib et al. | 400/618 |
| 5,066,984 | A | * | 11/1991 | Coombs | 400/619 |
| 6,457,887 | B1 | * | 10/2002 | Wotton et al. | 400/648 |

FOREIGN PATENT DOCUMENTS

JP 5-38855 2/1993

* cited by examiner

*Primary Examiner* — Jill Culler
(74) *Attorney, Agent, or Firm* — Patterson & Sheridan, LLP

(57) ABSTRACT

A printer according to an embodiment of the present invention is a printer which transports a recording medium, provided with a plurality of laminated sheets, along a predetermined transport path including a curved portion. The printer is provided with a dot head for printing the recording medium, a platen roller which faces the dot head with the recording medium therebetween, and a feed guide which is located on the downstream side of the dot head and the platen roller with respect to the direction of transport and guides the recording medium in a manner such that the recording medium is bent in a direction opposite to that in which the curved portion is bent.

2 Claims, 6 Drawing Sheets

PRINTER FOR A PLURALITY OF LAYERED SHEETS

BACKGROUND OF THE INVENTION

1. Field of the Invention

The present invention relates to a printer, and more particularly, to a printer for processing a recording medium formed of a plurality of laminated sheets.

2. Description of the Related Art

A printer is known that transports a recording medium, which is formed of a plurality of laminated sheets, along a predetermined transport path and performs various processes, including printing, in the middle of the path. If there is a curved portion in the transport path, differences are caused in feed rate between sheets outside and inside of the curved portion. If the sheets continue to be transported in this state, a printing shear or paper jam may be caused. In consideration of these circumstances, there is used a method in which a transport path is set in a straight line or a method in which adhesion between a plurality of sheets is improved. As described in Jpn. Pat. Appln. KOKAI Publication No. 5-38855, moreover, a technique is provided in which a bail roller is disposed extending near and along the outer peripheral surface of a platen roller that constitutes a curved portion of a transport path. According to this technique, the position of the bail roller is moved for adjustment such that sheets can be reversely transported in a curve at the same rate with the curved portion on the downstream side of the curved portion.

However, the above-described transport system has the following problems. If the transport path is restricted in configuration, then substantial limitations will be placed on the design and usability of the printer. Further, the improvement of the adhesion requires use of an expensive adhesive agent. Furthermore, a complicated mechanism must be used for the method in which the bail roller is moved based on the curved portion.

Accordingly, the object of the present invention is to provide a printer with a simple construction capable of preventing sheets of a recording medium from being deviated from one another.

BRIEF SUMMARY OF THE INVENTION

A printer according to an aspect of the present invention is a printer which transports a recording medium, provided with a plurality of laminated sheets, along a predetermined transport path including a curved portion, and comprises a dot head for printing the recording medium, a platen roller which faces the dot head with the recording medium therebetween, and a feed guide which is located on the downstream side of the dot head and the platen roller with respect to the direction of transport and guides the recording medium in a manner such that the recording medium is bent in the direction opposite to that in which the curved portion is bent.

A printer according to another aspect of the invention is a printer which transports a recording medium, provided with a plurality of sheets, along a predetermined transport path including a curved portion, and comprises a dot head for printing the recording medium, a platen roller which faces the dot head with the recording medium therebetween, a first feed roller which is located on the downstream side of the dot head and the platen roller with respect to the direction of transport and contacts a sheet or sheets inside the curved portion as the recording medium passes the curved portion, and a second feed roller which contacts a sheet or sheets outside the curved portion and holds and transports the recording medium in conjunction with the first feed roller, the feed rate of the first feed roller being higher than that of the second feed roller.

Objects and advantages of the invention will become apparent from the description which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

First Embodiment

A printer 10 according to a first embodiment of the present invention will now be described with reference to FIGS. 1 to 3.

Figure 1:
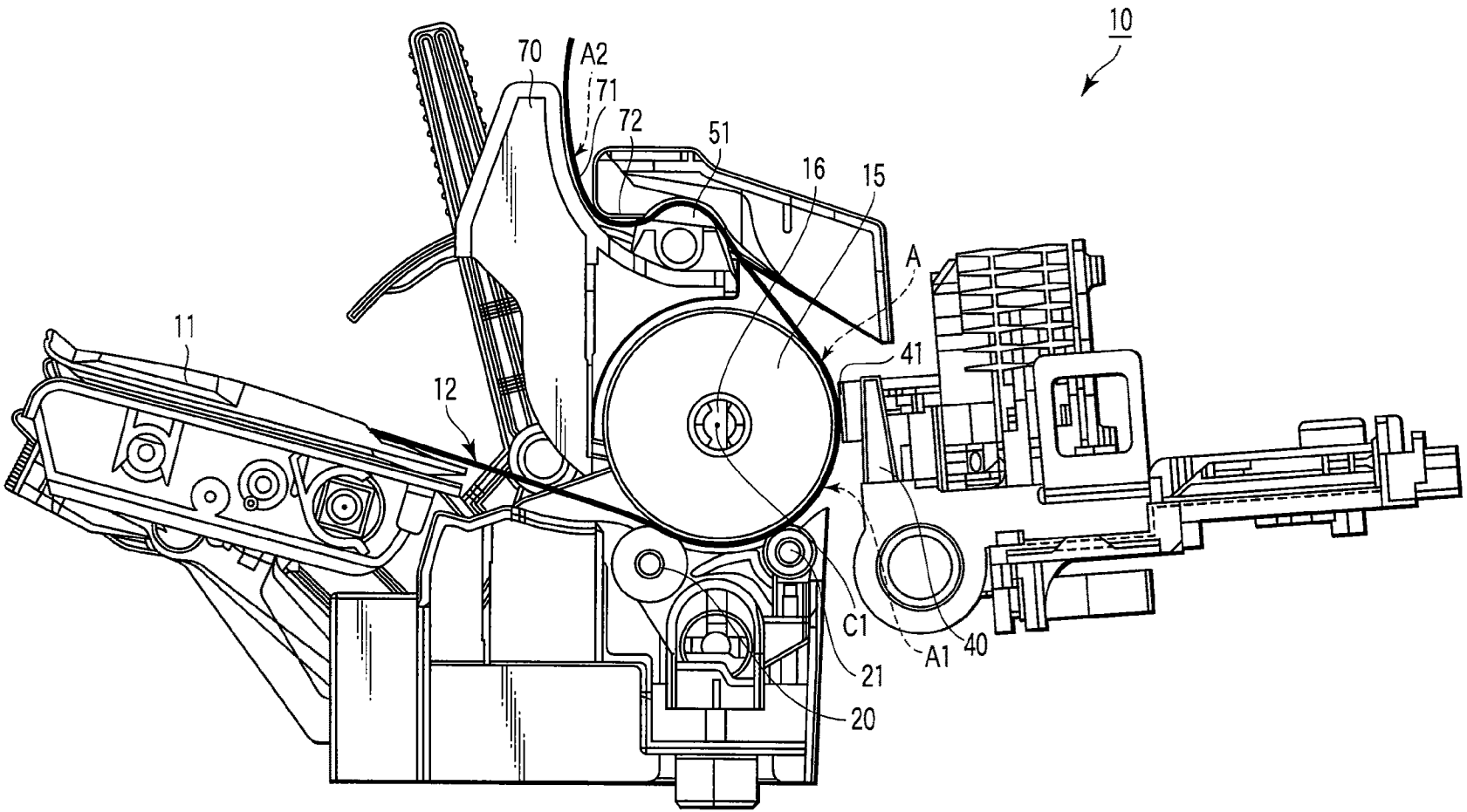
FIG. 1 is a side view showing principal parts of a dot printer according to a first embodiment of the invention.

FIG. 1 schematically shows the interior of the printer 10. The printer 10 is a wire dot printer in which a recording paper P as a recording medium, such as a continuous slip or a simple slip formed of a plurality of laminated sheets, is transported along a predetermined transport path and subjected to processing such as printing.

A push tractor 11 is provided on one end side (or left-hand side in FIG. 1) of the printer 10. The recording paper P as a set object to be processed is guided into the printer 10 through an inlet 12 of the push tractor 11 and transported along a predetermined transport path A indicated by broken line in FIG. 1. The inlet 12 forms an upstream end of the transport path, while an outlet 72 that is situated at the upper part of the printer 10 forms a downstream end of the transport path A.

A platen roller 15 is disposed in the central part of the printer 10. The platen roller 15 is integrally mounted on a rotatable platen shaft 16 that extends horizontally (or depthwise perpendicular to the drawing plane). The roller 15 is in the form of a horizontally extending column, which can rotate integrally with the platen shaft 16. The roller 15 is formed of an elastic material such as nitrile-butadiene rubber (NBR). The platen roller 15 is located opposite a dot head 41 (mentioned later) with the recording paper P between them.

Two pinch rollers 20 and 21 are arranged along the outer periphery of the platen roller 15. The rollers 20 and 21 are individually located opposite the platen roller 15 with the recording paper P between them.

A dot head unit 30 is disposed along the outer periphery of the platen roller 15. The head unit 30 is provided with the dot head 41 that is pressed and urged toward the roller 15.

The transport path A includes a first curved portion A1, which is curved forward and upward from the lower end part of the platen roller 15 along a front half (or right-hand half in FIG. 1) of the outer periphery of the platen roller 15 and further to the upper rear side.

The recording paper P is held between the pinch rollers 20 and 21, dot head 41, and platen roller 15. As the rollers 20, 21 and 15 rotate, the paper P is transported along the transport path A that includes the first curved portion A1. The direction of this transport is counterclockwise around the central shaft C1 of the platen roller 15.

The dot head 41 is located in a longitudinal (or substantially vertical) rear-facing orientation. The head 41 is disposed so as to contact a thermosensitive layer of the recording paper P and face the platen roller 15 with the paper P therebetween.

A first exit roller 51 is provided over the dot head 41 and the platen roller 15. The roller 51 is located over the platen roller 15 and at the back (or on the left-hand side in FIG. 1) of the dot head 41. Thus, the transport path A is additionally curved so as to return from the first curved portion A1 to the inlet 12.

An openable cover member 60 is provided over the first exit roller 51. The recording paper P is transported between the cover member 60 and the first exit roller 51. The cover member 60 can be opened and closed for the supply of the paper P, paper jam removal, etc., and protects the interior when it is closed. The distal end portion of the cover member 60 forms the outlet 72.

Further disposed on the downstream side of the first exit roller 51 is an exit guide (feed guide) 70 that extends to the outside of the printer 10 beyond the cover member 60. The guide 70 extends curved rearward and upward at the back (or on the left-hand side in FIG. 1) of the first exit roller 51. In this section, the recording paper P is transported clockwise around the center of curvature of a curved surface 71 of the exit guide 70.

Specifically, the transport path A includes a second curved portion A2, which is curved opposite to the first curved portion A1 that is formed in the right-hand curve of the platen roller 15, thus constituting an S-shaped configuration. This second curved portion A2 on the downstream side is formed near and outside the outlet 72. The second curved portion A2, which is curved reversely to the first curved portion A1, is configured so that there is a difference between sheet feed rates inside and outside the curve, as in the first curved portion A1. For example, the curvature of the curved surface 71 may be set equal to that of the outer peripheral surface of the platen roller 15.

As the platen roller 15, pinch rollers 20 and 21, and first exit roller 51 are driven at a predetermined feed rate by a motor (not shown), the recording paper P is fed along the transport path A from the inlet 12 toward the outlet 72.

The following is a description of the operation of the printer 10 according to the present embodiment.

The recording paper P is set in the push tractor and fed obliquely downward and forward (or downward to the right in FIG. 1) through the inlet 12. The paper P that is carried into the printer 10 passes through the spaces between the platen roller 15 and the pinch rollers 20 and 21 and is transported in a curve along the outer periphery of the roller 15 and the first curved portion A1.

Then, the recording paper P is printed as it passes between the platen roller 15 and the dot head 41 at the outer periphery of the roller 15 and is fed upward and rearward (or to the left in FIG. 1). Further, the paper P advances rearward (or to the left in FIG. 1) between the first exit roller 51 and the cover member 60. Finally, the paper P is guided along the curved surface 71 of the exit guide 70 between the cover member 60 and the guide 70, transported along the second curved portion A2 that is curved opposite to the first curved portion A1, and discharged through the outlet 72.

Figure 2:
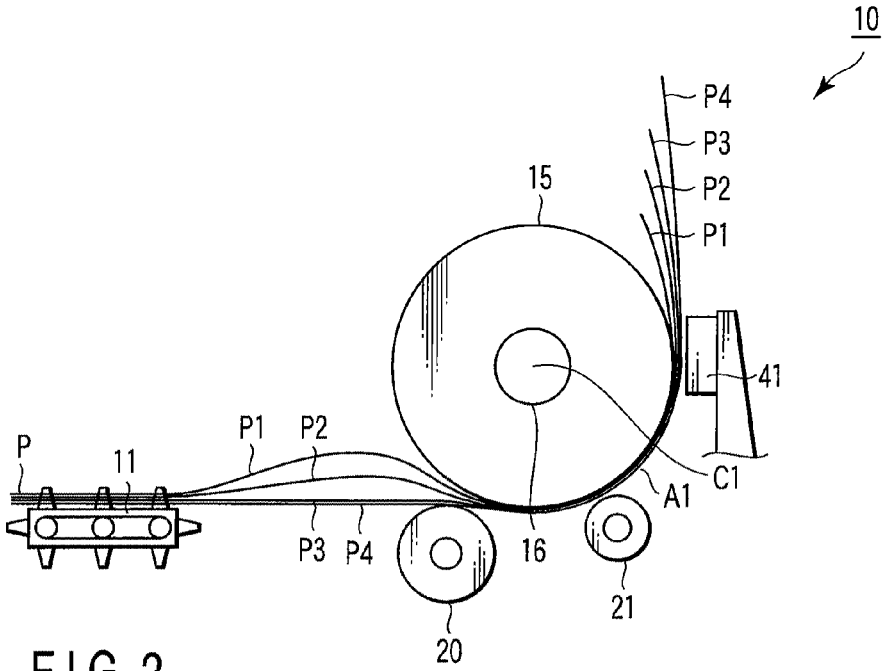
FIG. 2 is a side view illustrating a transporting operation of the dot printer.
Figure 3:
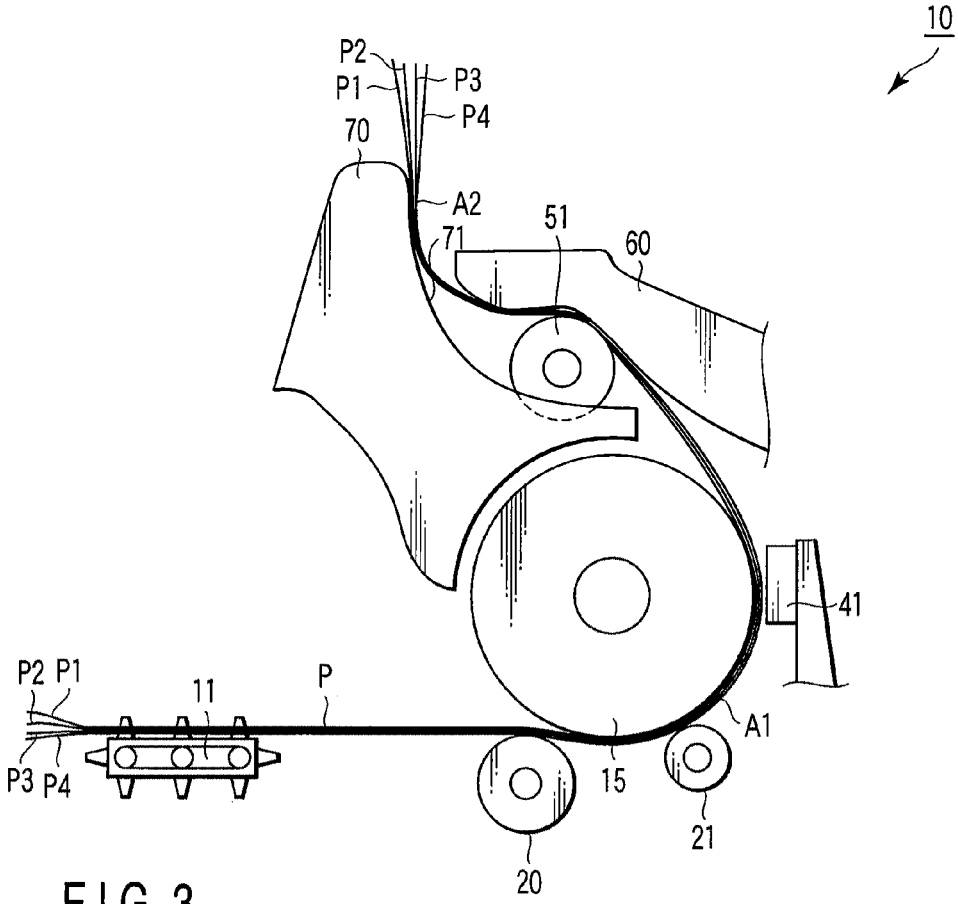
FIG. 3 is a side view illustrating the transporting operation of the dot printer.

Referring to FIGS. 2 and 3, there will be described an operation in which a plurality of sheets P1 to P4 (four sheets in the illustrated case) that constitute the recording paper P are fed along the transport path A of the printer 10 of the present embodiment. FIG. 2 shows a state immediately after the first curved portion A1 is passed, and FIG. 3 shows a state immediately after the second curved portion A2 is passed. After having passed the first curved portion A1, as shown in FIG. 2, sheets P1 to P4 are fed in a manner such that sheets P3 and P4 on the outer side of the curve are fed farther than sheets P1 and P2 on the inner side. Accordingly, the inner sheets are subject to deflections in regions ahead of the platen roller 15.

Since the second curved portion A2 is curved in the direction opposite to that in which the first curved portion A1 is curved, as shown in FIG. 3, sheets P1 and P2 and the like that are situated inside at the first curved portion A1 are situated outside at the second curved portion A2. Thus, sheets P1 and P2 and the like are fed farther than sheets P3 and P4. After the second curved portion A2 is passed, therefore, a deviation caused at the first curved portion A1 is eliminated.

The printer 10 according to the present embodiment has the following effects. The outlet 72 is provided with the curved exit guide 70 so as to form the curved portion A2 that is curved opposite to the first curved portion A1 of the transport path A. Therefore, differences between the respective feed rates of the inner and outer sheets P1 to P4 for the case where the transport path A is curved can be adjusted with a simple configuration without adjusting the feed rates of the rollers. Since the exit guide 70 is located outside the printer 10, moreover, the degree of freedom in the design of the internal structure of the printer 10 itself can be ensured.

Second Embodiment

A dot printer 120 according to a second embodiment of the present invention will now be described with reference to FIGS. 4 and 5. Since the components other than a second exit roller 52 have the same configurations as those of their counterparts in the first embodiment, like numbers are used to designate those components, and a description thereof is omitted.

Figure 4:
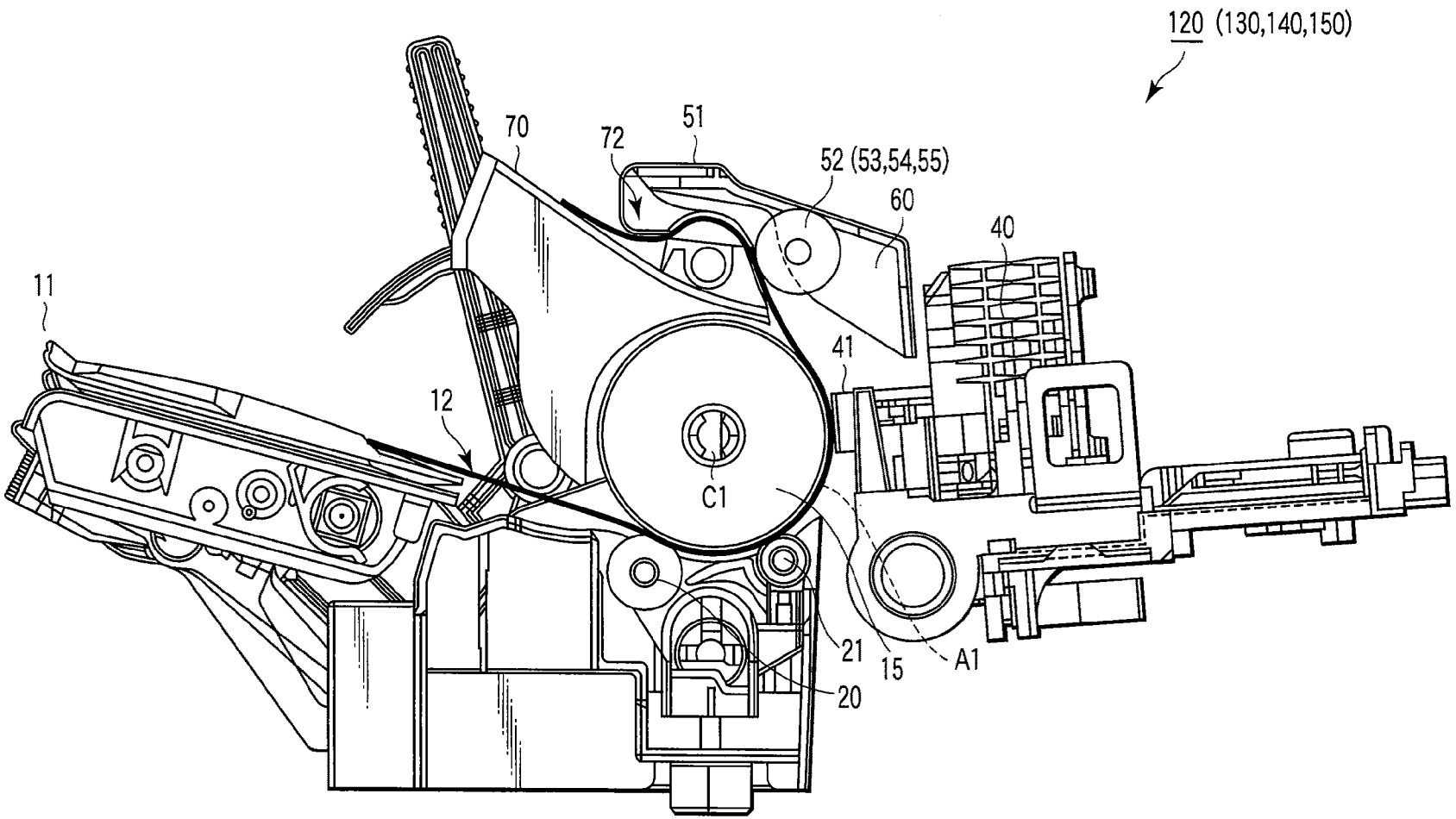
FIG. 4 is a side view showing principal parts of a dot printer according to a second embodiment of the invention.

As shown in FIG. 4, an outlet 72 is provided with the second exit roller 52 that faces a first exit roller 51 with a recording paper P between them. Further, an exit guide 70 is not curved, so that a curved portion A2 is not formed.

The feed rate of the first exit roller 51 is made higher than that of the second exit roller 52 by adjusting the output of a motor. In this case, the rotational speed of the first exit roller 51 is set to be higher than that of the second exit roller 52. Thus, in the present embodiment, differences between the respective feed rates of inner and outer sheets caused by a first curved portion A1 can be canceled by varying the motor output to adjust the respective feed rates of the first and second exit rollers 51 and 52.

In the dot printer 120, as shown in FIG. 4, the individual sheets are deviated from one another at the first curved portion A1. Since the rotational speed of the first exit roller 51 is higher than that of the second exit roller 52, however, the inner sheets are fed farther between the exit rollers than the outer sheets by the exit rollers, so that the deviation is eliminated.

Figure 5:
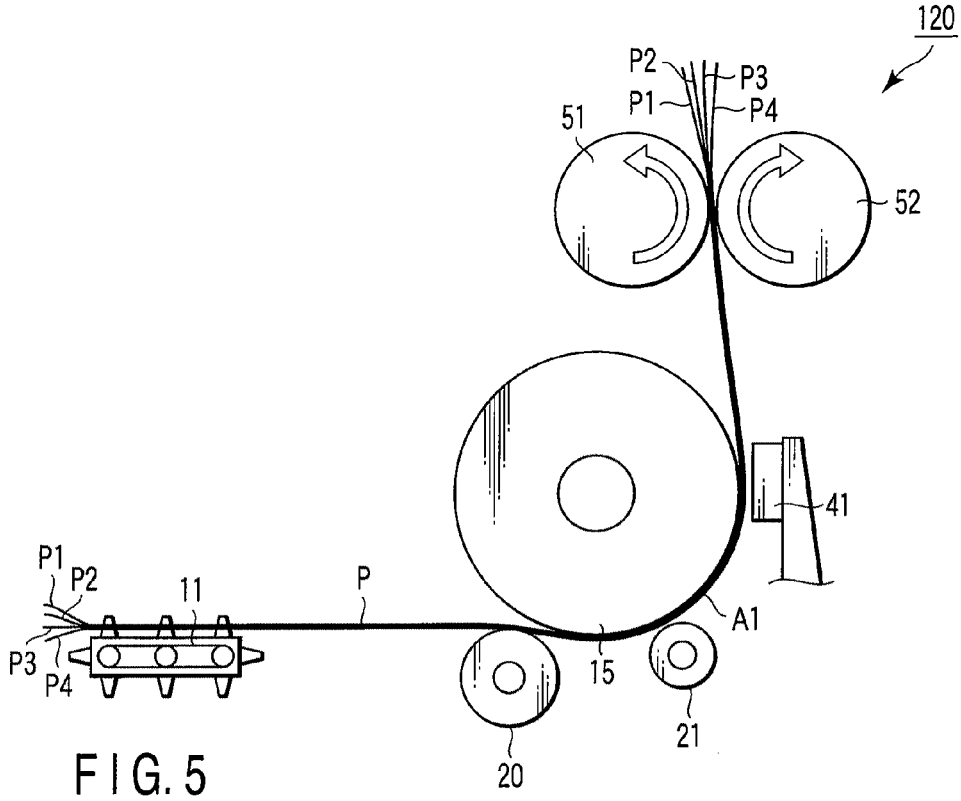
FIG. 5 is a side view illustrating a transporting operation of the dot printer.

Referring to FIGS. 2 and 5, there will be described an operation in which a plurality of sheets P1 to P4 (four sheets in the illustrated case) that constitute the recording paper P are fed along a transport path A of the printer 120 of the present embodiment. A state shown in FIG. 2 is established immediately after the first curved portion A1 is passed, as in the case of the first embodiment.

After sheets P1 to P4 have passed between the first and second exit rollers 51 and 52, as shown in FIG. 5, the rotational speed of the first exit roller 51 is high. Thus, sheets P1 and P2 and the like on the inner side of the first curved portion A1 are fed farther than sheets P3 and P4 on the outer side, so that a deviation caused at the first curved portion A1 is eliminated.

The dot printer 120 can also produce the same effects of the first embodiment. Further, the shape of the exit guide 70 can be simplified.

Third Embodiment

Figure 6:
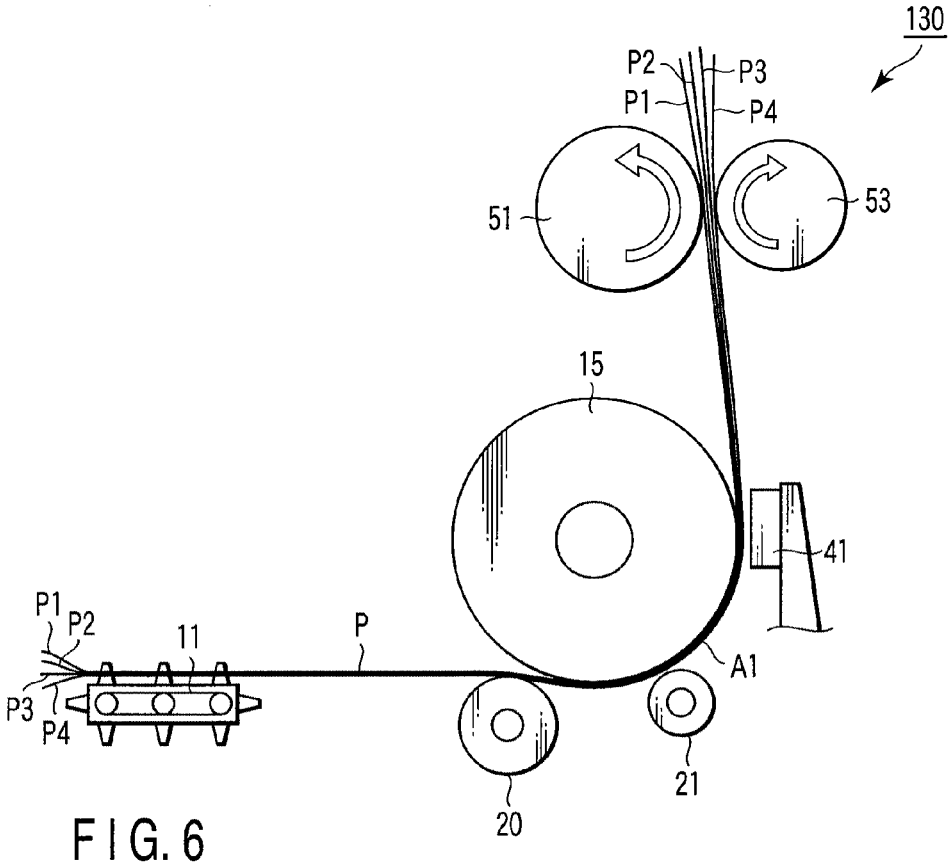
FIG. 6 is a side view illustrating a transporting operation of a dot printer according to a third embodiment of the invention.

A dot printer 130 according to a third embodiment of the present invention will now be described with reference to FIGS. 4 and 6. Since the components other than a second exit roller 53 have the same configurations as those of their counterparts in the first and second embodiments, like numbers are used to designate those components, and a description thereof is omitted.

As shown in FIG. 4, an outlet 72 is provided with the second exit roller 53 that faces a first exit roller 51 with a recording paper P between them. Further, an exit guide 70 is not curved, so that a curved portion A2 is not formed.

The feed rate of the first exit roller 51 is made higher than that of the second exit roller 53. In this case, as shown in FIG. 6, the outside diameter of the first exit roller 51 is set to be larger than that of the second exit roller 53. Thus, in the present embodiment, differences between the respective feed rates of inner and outer sheets caused by a first curved portion A1 can be canceled by differentiating the respective outside diameters of the first and second exit rollers 51 and 52 to adjust the feed rates thereof.

In the dot printer 130, as shown in FIG. 2, the individual sheets are deviated from one another at the first curved portion A1. Since the outside diameter of the first exit roller 51 is larger than that of the second exit roller 53, as shown in FIG. 6, the inner sheets P1 and P2 are fed farther between the first and second exit rollers 51 and 53 than the outer sheets P3 and P4, so that a deviation caused at the first curved portion A1 is eliminated.

The dot printer 130 can also produce the same effects of the dot printers 10 and 120 of the first and second embodiments. Further, the shape of the exit guide 70 can be simplified. Since the motor output need not be varied for the two exit rollers 51 and 53, moreover, the motor drive is simple.

Fourth Embodiment

Figure 7:
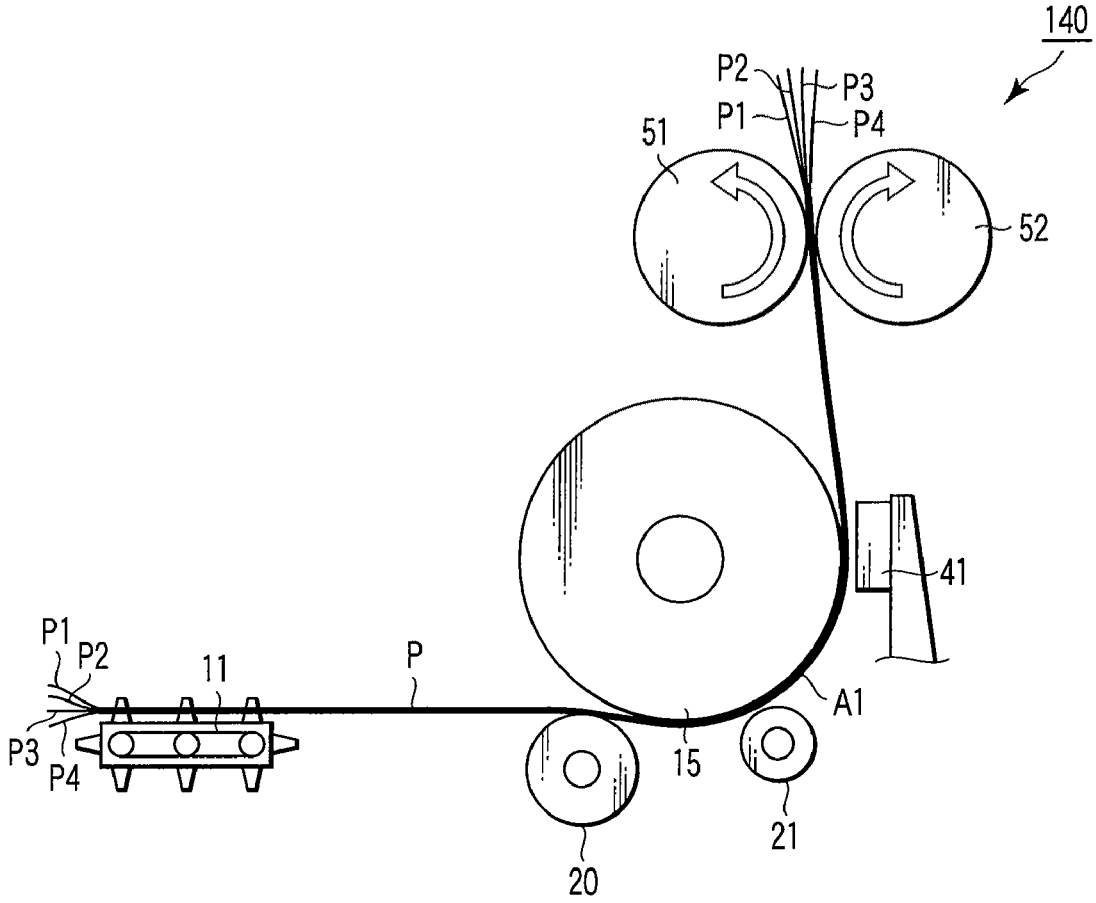
FIG. 7 is a side view illustrating a transporting operation of a dot printer according to a fourth embodiment of the invention.

A dot printer 140 according to a fourth embodiment of the present invention will now be described with reference to FIGS. 4 and 7. Since the components other than a second exit roller 54 have the same configurations as those of their counterparts in the first and second embodiments, like numbers are used to designate those components, and a description thereof is omitted.

As shown in FIG. 4, an outlet 72 is provided with the second exit roller 54 that faces a first exit roller 51 with a recording paper P between them. Further, an exit guide 70 is not curved, so that a curved portion A2 is not formed.

The feed rate of the first exit roller 51 is made higher than that of the second exit roller 54. In this case, a material that constitutes the outer surface of the first exit roller 51 is formed of ethylene-propylene rubber (EPDM) or nitrile-butadiene rubber (NBR), while a material that constitutes the outer surface of the second exit roller 54 is formed of polyacetal (POM) or the like. Accordingly, the two exit rollers are different in frictional force such that the friction coefficient of the outer surface of the first exit roller 51 is higher than that of the outer surface of the second exit roller 54. Thus, the feed rate on the first exit roller 51 side is so high that differences between the respective feed rates of inner and outer sheets caused by a first curved portion A1 can be canceled by adjusting the respective feed rates of the first and second exit rollers 51 and 52.

In the dot printer 140, as shown in FIG. 2, the individual sheets are deviated from one another immediately after the first curved portion A1 is passed. Since the frictional force and feed rate of the first exit roller 51 are greater or higher than those of the second exit roller 54, the inner sheets P1 and P2 are fed farther than the outer sheets P3 and P4 when the recording paper P is fed between the first and second exit rollers 51 and 54, as shown in FIG. 7. Thus, a deviation caused at the first curved portion A1 is eliminated.

The same effects of the first to third embodiments can also be obtained from the present embodiment. Further, the shape of the exit guide 70 can be simplified. Since the two exit rollers 51 and 54 can have the same outside diameter and be subjected to the same motor driving force, moreover, the driving force can be adjusted with ease, and the design is subject to few restrictions.

Fifth Embodiment

A dot printer 150 according to a fifth embodiment of the present invention will now be described with reference to FIGS. 4 and 8. Since the components other than a second exit roller 55 have the same configurations as those of their counterparts in the first embodiment, like numbers are used to designate those components, and a description thereof is omitted.

As shown in FIG. 4, an outlet 72 is provided with the second exit roller 55 that faces a first exit roller 51 with a recording paper P between them. Further, an exit guide 70 is not curved, so that a curved portion A2 is not formed.

Further, the dot printer 150 is provided with a sheet number detection section 75, space adjusting means 80, and feed rate adjusting means 90. The sheet number detection section 75 receives or detects the number of sheets or thickness of the recording paper P as an input. The space adjusting means 80 adjusts the space between a dot head 41 and a platen roller 15 based on the result of the detection or input. The feed rate adjusting means 90 adjusts the respective feed rates of outside and inside feed rollers based on the number of sheets or thickness of the recording paper P. The feed rate adjusting means 90 serves to adjust the driving force of a motor and rotational speed.

If the recording paper P is formed of a plurality of sheets, for example, the rotational speed of the first exit roller 51 is adjusted to be higher than that of the second exit roller 55, whereupon the feed rate of the first exit roller 51 is higher than that of the second exit roller 55.

If the recording paper P is formed of a single sheet, on the other hand, the feed rate of the first exit roller 51 is adjusted to be equal to that of the second exit roller 55.

Thus, in the dot printer 150, differences between the respective feed rates of inner and outer sheets caused by a first curved portion A1 can be canceled by adjusting the respective feed rates of the first and second exit rollers 51 and 52.

Figure 8:
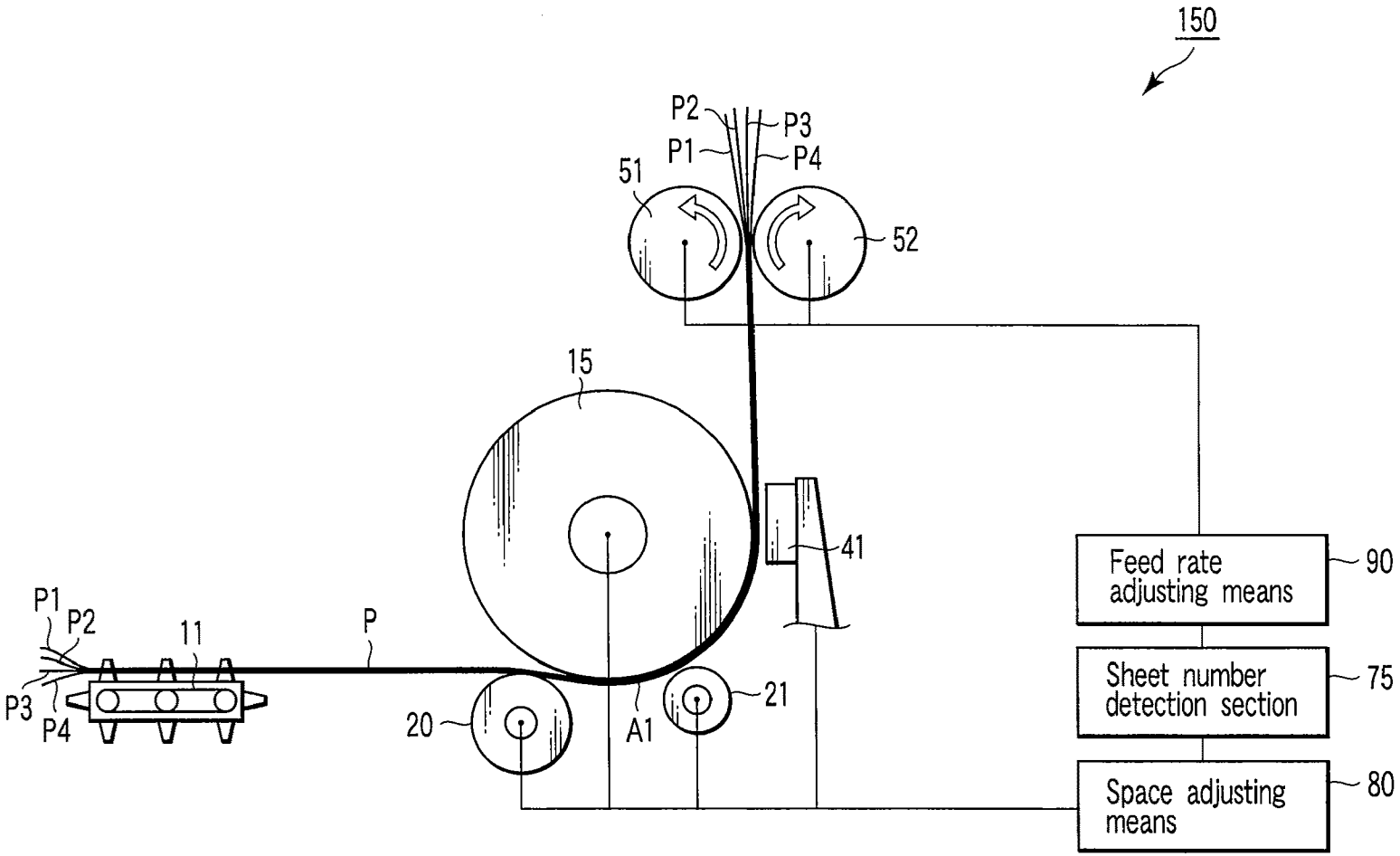
FIG. 8 is a side view illustrating a transporting operation of a dot printer according to a fifth embodiment of the invention.

In the dot printer 150, as shown in FIG. 8, the individual sheets are deviated from one another at the first curved portion A1. Since the rotational speed of the first exit roller 51 is higher than that of the second exit roller 55, however, the inner sheets P1 and P2 are fed farther between the exit rollers than the outer sheets P3 and P4, so that a deviation is eliminated.

The dot printer 150 can also produce the same effects of the second embodiment. Further, the shape of the exit guide 70 can be simplified. Besides, the recording paper P can be suitably transported according to the number of sheets included therein. Furthermore, the it is easily applicable to an apparatus that has a function to adjust the space between the dot head 41 and the platen roller 15 depending on the number of sheets, since the apparatus requires only few configurations anew.

The present invention is not limited to the embodiments described herein. It is to be understood, in carrying out the invention, that the components of the invention may be variously modified without departing from the spirit or scope of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the inventive as defined by the appended claims and equivalents thereof.

What is claimed is:

1. A printer which transports a recording medium, said recording medium comprising a plurality of layered sheets, along a predetermined transport path including a curved portion, the printer comprising:

a dot head for printing on the recording medium;

a platen roller which faces the dot head with the recording medium therebetween; and a feed guide which is located on a downstream side of the dot head and the platen roller with respect to a direction of transport and guides the recording medium in a manner such that the recording medium is bent in a direction opposite to that in which the curved portion is bent and to have a curvature equal to a curvature of the curved portion such that each sheet in the plurality of layered sheets is transported at a rate that is equal to the other sheets in the plurality of layered sheets to prevent the sheets from being separated from one another.

2. A method for transporting a plurality of layered sheets through a printer along a predetermined transport path including a curved portion, the method comprising:

transporting the plurality of layered sheets past a dot head configured to print on the plurality of layered sheets;

transporting the plurality of layered sheets past a platen roller which faces the dot head with the plurality of layered sheets therebetween; and downstream from the dot head and the platen roller, guiding the plurality of layered sheets in a manner such that the plurality of layered sheets is bent in a direction opposite to that in which the curved portion is bent and to have a curvature equal to a curvature of the curved portion such that each sheet in the plurality of layered sheets is transported at a rate that is equal to the other sheets in the plurality of layered sheets to prevent the sheets from being separated from one another.

* * * * *